United States Patent [19]

Nordstrom

[11] 4,316,423

[45] Feb. 23, 1982

[54] METHOD FOR MAKING A HYBRID WATERBED MATTRESS

[76] Inventor: Manfred A. Nordstrom, 1618 River St., Burlington, Iowa 52601

[21] Appl. No.: 238,419

[22] Filed: Feb. 26, 1981

[51] Int. Cl.[3] ..... D05B 97/00; A47C 27/08

[52] U.S. Cl. ..... 112/262.1; 5/451

[58] Field of Search ..... 112/262.1, 265.2, 3 R, 112/3 A; 5/451, 470, 452

[56] References Cited

U.S. PATENT DOCUMENTS

| | | | |
|---|---|---|---|
| 4,019,451 | 4/1977 | Autrey | 112/3 R X |
| 4,057,862 | 11/1977 | La Bianco | 5/470 X |
| 4,155,317 | 5/1979 | Enomoto | 112/3 R |
| 4,186,455 | 2/1980 | Fox, Jr. et al. | 5/451 |
| 4,187,566 | 2/1980 | Peterson | 5/451 |
| 4,187,567 | 2/1980 | Crowther | 5/451 |

*Primary Examiner*—H. Hampton Hunter

*Attorney, Agent, or Firm*—Woodard, Weikart, Emhardt & Naughton

[57] ABSTRACT

A method for making the top panel and border of a hybrid waterbed mattress is described herein which includes sewing a top panel together with a flanging material along first and second parallel lines, sewing the top half of a zipper to the top panel and flanging material along third and fourth lines, the third line being spaced between the first and second lines and the fourth line being about along the first line, sewing the bottom half of the zipper to the side panel of the mattress and sewing a tape over the edges of the top panel, flanging material and top half of the zipper along a fifth line parallel with and intermediate the first and second lines.

8 Claims, 2 Drawing Figures

METHOD FOR MAKING A HYBRID WATERBED MATTRESS

BACKGROUND OF THE INVENTION

1. Field of the Invention

The present invention relates to a method for making a mattress, and more particularly for making a top panel and border of a hybrid waterbed mattress.

2. Description of the Prior Art

In U.S. Pat. No. 4,187,567, issued to Crowther on Feb. 12, 1980, there is disclosed a waterbed including a central, rigid frame member attached to a base, and a cap having rigid side walls encompassing the central frame. The water bladder is held within the central frame member and a top cushion on the cap overlies the bladder. In the Crowther construction, padding covers are placed over the top cushion and mattress sides, and are sewn together at the edges and covered with tape in conventional fashion. Another water mattress construction is shown in U.S. Pat. No. 4,187,566, issued to Peterson on Feb. 12, 1980. In the Peterson mattress, coverings on the mattress top and sides are sewn and taped along their edges and the side coverings include a central zipper sewn therein.

A composite waterbed mattress is disclosed in U.S. Pat. No. 4,186,455, issued to Fox et al. on Feb. 5, 1980. The Fox et al. mattress includes a coverlet of cotton or foam padding surrounding the mattress. The waterbed disclosed in U.S. Pat. No. 4,057,862, issued to LaBianco on Nov. 14, 1977, includes wedge-shaped, pivoted pads at the sides to give lateral support to the water and to receive bed coverings therebetween.

SUMMARY OF THE INVENTION

A method for making the top panel and border of a hybrid waterbed mattress is disclosed herein which comprises sewing a flanging material to a top panel along first and second parallel lines adjacent the edge of a mattress, sewing the top half of a zipper to the top panel and flanging material along a pair of lines adjacent the edge of the mattress, sewing the bottom half of the zipper to the side panel of the mattress, and sewing a tape over the edges of the top panel, flanging material and the top half of the zipper.

It is an object of the present invention to provide a hybrid waterbed mattress which is secure, and which will withstand the pressures and forces involved in a waterbed mattress.

It is another object of the present invention to provide a border and top panel for a hybrid waterbed mattress which has the appearance of a regular spring mattress.

A further object of the present invention is to provide a method for making the border and top panel of a hybrid waterbed mattress which is simple and easily performed, and which has the above-mentioned advantages.

Further objects and advantages of the present invention will become apparent from the description of the preferred embodiment which follows.

DESCRIPTION OF THE PREFERRED EMBODIMENT

Figure 1:
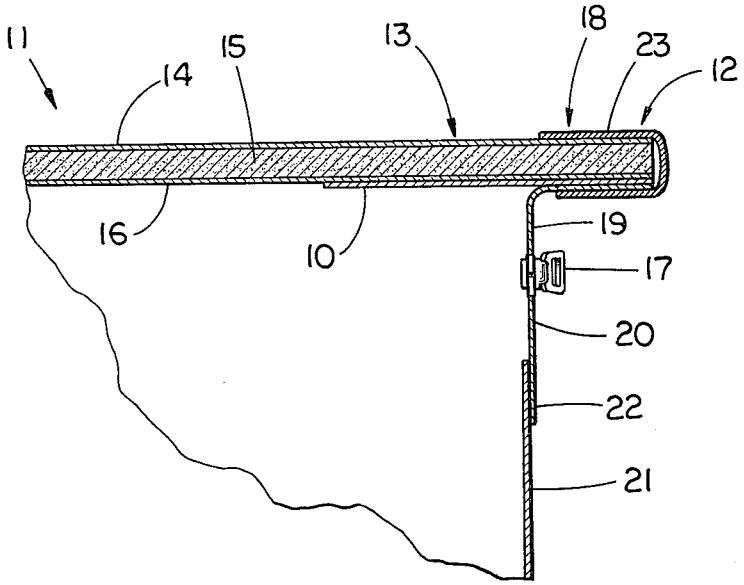
FIG. 1 is a partial, cross-sectional end view of the top panel and border of a waterbed mattress constructed in accordance with the method of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
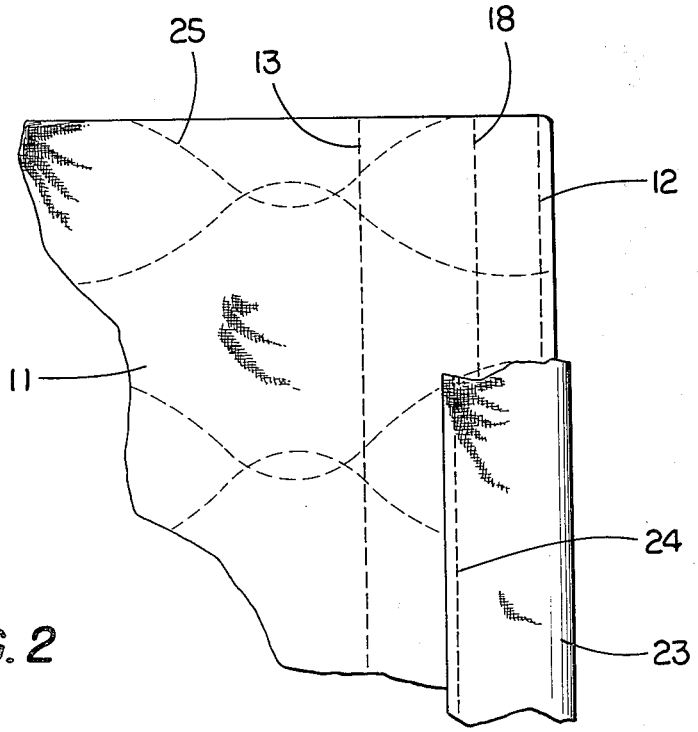
FIG. 2 is a partial, cross-sectional top view of a waterbed mattress constructed in the manner of FIG. 1.

Referring in particular to the drawings, the present invention provides a method for making the top panel and border of a hybrid waterbed mattress. This is a type of a waterbed mattress that has foam around the perimeter and a panel on top of the bladder instead of a true waterbed which is just a bladder filled with water and contained in some type of a bin. The first step involves the sewing of a flanging material 10 to a top panel 11 along first and second parallel lines, 12 and 13, respectively. The top panel typically comprises a top layer 14 of a suitable fabric, a filler material 15 such as a plydacron, and a backing layer 16. The backing layer typically may comprise a suitable grid work for retaining the polydacron or other filler material in position, and the backing layer preferably comprises a leno cloth. Most desirably, the top layer is multi-needle quilted, as shown at 25 (FIG. 2), to the filler material and the backing layer to provide a secure top panel.

The top layer is preferably sewn with the flanging material along a line 12 adjacent the edge of the mattress and along a second line 13 spaced inwardly therefrom along the top panel. These two seams are preferably formed at the same time by sewing with a double headed sewing machine as will be understood in the art. The flanging material 10 is typically used in the prior art to be taken around the insulating cotton materials and fastened to the side of the spring unit to form the inner roll of the standard mattress. However, as will be seen the flanging material is not used for that purpose in the present invention.

The next step in the method of the present invention is to sew the top panel through to the flanging material and to the top half of a zipper 17 along a third line 18 parallel with and spaced between the lines 12 and 13. The top half 19 of the zipper 17 is also sewn simultaneously to the top panel 11 and flanging material 10 along about the first line 12 adjacent the edge of the mattress. The bottom half 20 of the zipper 17 is then sewn to the side panel 21 of the mattress along a line 22. In this manner, the top panel may be removed from the mattress by operation of the zipper 17. As in the earlier instance, it is desirable that the top half 19 of the zipper 17 be sewn along the two lines 18 and 12 at the same time by use of a double seaming sewing machine.

The next step of the method of the present invention is to apply a tape onto the welt edge to cover the edges of the top panel, flanging material and top half of the zipper. The tape 23 is sewn through these layers along a fourth line 24 parallel with and intermediate the first and second lines 12 and 13.

The waterbed mattress produced as a result of the described method is very strong and also has the desirable appearance of the usual spring mattress. The method is simple to perform and does not require any unusual materials or equipment except those which are readily available and may be easily adapted for use in the described method.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for making the border and top panel of a hybrid waterbed mattress which comprises the steps of:

(a) sewing a flanging material to a top panel along first and second parallel lines, the first line being adjacent the edge of the mattress and the second line being spaced inwardly therefrom along the top panel;

(b) sewing the top half of a zipper simultaneously to the top panel and flanging material along a third line parallel with and spaced between the first and second lines;

(c) sewing the top half of the zipper simultaneously to the top panel and flanging material along about the first line;

(d) sewing the bottom half of the zipper to the side panel of the mattress, thereby permitting the top panel to be removed from the mattress by operation of the zipper; and (e) sewing a tape over the edges of the top panel, flanging material and top half of the zipper along a fourth line parallel with and intermediate the first and second lines.

2. The method of claim 1 in which step (a) comprises simultaneously sewing the flanging material to the top panel along the first and second lines.

3. The method of claim 1 in which the top panel comprises a top layer, a filler material and a backing layer.

4. The method of claim 3 in which the top layer is multi-needle quilted to the filler material and the backing layer.

5. The method of claim 4 in which the filler material is plydacron and in which the backing layer is leno cloth.

6. The method of claim 4 in which step (a) comprises simultaneously sewing the flanging material to the top panel along the first and second lines.

7. The method of claim 1 in which step (e) comprises sewing the tape along a fourth line along about the third line.

8. The method of claim 7 in which step (a) comprises simultaneously sewing the flanging material to the top panel along the first and second lines.

* * * * *

UNITED STATES PATENT AND TRADEMARK OFFICE

CERTIFICATE OF CORRECTION

PATENT NO. : 4,316,423

DATED : February 23, 1982

INVENTOR(S) : Manfred A. Nordstrom

It is certified that error appears in the above-identified patent and that said Letters Patent are hereby corrected as shown below:

In column 4, line 19, please change "plydacron" to --polydacron--.

Signed and Sealed this

*Twenty-fifth* Day of *May 1982*

[SEAL]

*Attest:*

*Attesting Officer*

GERALD J. MOSSINGHOFF

*Commissioner of Patents and Trademarks*